United States Patent [19]

Howard

[11] Patent Number: 4,784,290

[45] Date of Patent: Nov. 15, 1988

[54] APPARATUS FOR DISPENSING WET WIPES

[75] Inventor: John A. Howard, Bedford, England

[73] Assignee: Lever Brothers Company, New York, N.Y.

[21] Appl. No.: 555,737

[22] Filed: Nov. 28, 1983

[30] Foreign Application Priority Data

Nov. 29, 1982 [GB] United Kingdom ..... 8233988

[51] Int. Cl.[4] ..... B65H 1/00

[52] U.S. Cl. ..... 221/63; 221/135; 221/307

[58] Field of Search ..... 221/33, 45, 46, 63, 221/135, 303, 307, 310, 47, 48, 55, 44, 49, 61, 62

[56] References Cited

U.S. PATENT DOCUMENTS

| | | | |
|---|---|---|---|
| 3,868,052 | 2/1975 | Rockefeller . | |
| 3,973,695 | 8/1976 | Ames . | |
| 3,982,659 | 9/1976 | Ross . | |
| 3,994,417 | 11/1976 | Boedecker | 221/48 |
| 4,180,160 | 12/1979 | Ogawa et al. | 221/63 X |
| 4,289,262 | 9/1981 | Finkelstein | 221/63 X |

FOREIGN PATENT DOCUMENTS

| | | | |
|---|---|---|---|
| 1096821 | 3/1981 | Canada . | |
| 2421178 | 11/1974 | Fed. Rep. of Germany | 221/33 |
| 775195 | 12/1934 | France . | |
| 1419167 | 12/1975 | United Kingdom . | |

*Primary Examiner*—Joseph J. Rolla
*Assistant Examiner*—David H. Bollinger
*Attorney, Agent, or Firm*—Milton L. Honig; James J. Farrell

[57] ABSTRACT

The invention pertains to a seal for dispensing wet wipes from a container comprising a tube of generally tapered form having a relatively wide mouth for receiving wipes and a relatively narrow orifice for dispensing them, the tube being divided circumferentially into relatively rigid and relatively flexible axially extending zones, so that when a wet wipe is dispensed the orifice is capable of expansion.

The seal according to the invention provides good dispensing action and prevents to a significant extent evaporation of the impregnated liquid.

6 Claims, No Drawings

APPARATUS FOR DISPENSING WET WIPES

This invention relates to an apparatus for dispensing articles which are coming to be known as wet wipes.

Wet tissues have been used, particularly in the travel trade, for many years. Most common are individual tissues often packed in metallised plastics foil. More recently continuous rolls of wet tissue or non-woven materials have been sold for use for major cleaning jobs, and these have become known as wet wipes. The roll of wipes is perforated so that individual sheets can be detached as they are dispensed from a container through a seal. The design of the seal is critical to the success of a wet wipe product because it must comply with three major criteria. First, it must apply little enough friction to the wipe to allow it to be pulled through the seal without breaking prematurely and yet enough to allow the individual wipe to be detached when its perforation has been pulled through. Secondly, it must be designed so that after one wipe has been detached, just enough of the second one appears downstream of the seal to allow it to be pulled through by the user. Lastly, insufficient of the second wipe should be presented to allow wicking and evaporation to occur to a significant extent, of the impregnated liquid from the immediately subsequent wipes or from the bulk of the roll.

These criteria are difficult to establish simultaneously.

The present invention provides a novel design for a seal suitable for use with wet wipes which meets the criteria set out above.

Accordingly, the present invention provides a seal for dispensing wet wipes from a container comprising a tube of generally tapered form having a relatively wide mouth for receiving wipes and a relatively narrow orifice for dispensing them, the tube being divided circumferentially into relatively rigid and relatively flexible axially extending zones, so that when a wet wipe is dispensed the orifice is capable of expansion.

The seals of this invention will generally be made of plastics and formed by a plastics moulding technique such as vacuum moulding.

The seals are particularly appropriate for use with a cassette of wet wipes intended to be housed in a larger housing for use in a washroom, for example. In that case the cassette will be sold complete with the seal. However, the seals may also be used on containers of wipes intended for the retail trade.

The invention will be further described with reference to the accompanying drawings, in which FIGS. 1, 2 and 3 are perspective views of a seal in accordance with the invention.

Referring first to FIG. 1, a seal is shown which consists of a tube having a relatively wide circular mouth (10) which tapers abruptly to an extremely elongated, waisted elliptical orifice (11). A wet wipe (12) is shown protruding through the seal in a partly dispensed form.

The circumference of the ellipse is effectively divided into four zones, two zones (13) which because of their small radius of curvature are relatively rigid and two zones (14), which are slightly concave and which because of their length of curvature are flexible and able to move apart from each other to permit passage of the wipe through the orifice.

Referring now to FIG. 2, the seal shown has the same wide mouth (100 as that of FIG. 1, but tapers to a three cornered orifice (15). In this instance the circumference of the tube at the orifice is divided into six zones, that is to say three relatively rigid zones (16) at the three corners and three relatively flexible zones (17) intermediate the corners where the tube is concave and its walls are able to move outwards to allow passage of the body of the wipe through the orifice.

Referring lastly to FIG. 3, the seal again has a wide tubular mouth (10) of circular cross-section. The mouth runs into an expanding conical annulus (18) before tapering into a pear-shaped orifice (19). In this instance the top of the pear forms the relatively rigid zone (20) and the two sides of the neck (21) form the relatively flexible zones which are able to expand as shown by the arrows to accommodate the body of the wipe.

It will be appreciated that because of the existence of the relatively flexible zones in the walls of the seal, the orifice will progressively flex to accommodate variations in the bulk of the wipe due to changes in the bulk of the basic web material, the quantity of impregnated liquid, and the manner of folding of the web as it is pulled from the centre of a roll through the wide mouth and the seal as the wipe is pulled. Equally the seal will exert a pressure on the wipe. This pressure has two functions. First, immediately after one wipe has been broken off, leaving only enough of the subsequent wipe protruding through the seal for it too be taken hold of and pulled through, the pressure prevents undue wicking and evaporation of the liquid with which the wipe is impregnated. Secondly, it provides resistance to the passage of the wipe and consequently allows a first wipe to be detached from a roll after a second one has just emerged through the seal.

Reliable dispensing action of the above described system is, of course, dependent on the specific ratio between the force necessary to pull the wipes through the seal out of the dispenser and the perforation strength of the wipes, i.e. the strength of the paper at the line of perforation between two successive wipe tissues.

The perforation strength is directedly related to the overall strength of the wipe material and the specific perforation pattern which is used to separate successive wipe tissues.

The pull out force is equal to the total resistance arising from the friction caused by the dispenser seal itself and by the wipes unrolling and reaching the seal. Although in general it is quite possible to use a dispenser seal according to the present invention which in combination with the other frictional parameters of the system results in a pull out force which is greater than the perforation strength of the wipes being employed, it is preferred that the ratio between the pull out force and the perforation strength falls within the range of from about 1:1 to 1:2 thereby ensuring reliable dispensing action throughout the entire wipe load of the container.

The seal according to the present invention can be particularly advantageous in preventing vapor loss from immediately subsequent wipes or from the bulk of the wipe load in the cassette, when used in combination with wet wipes provided with a hydrophobic barrier pattern as described in the EP specification No. 0 068 722.

Although the invention has been focused primarily on the dispensing and vapor loss problem with wet wipes, it will be appreciated that the present seal design can also be suitably used for the dispensing of wipes in dry form.

I claim:

1. A container for dispensing wet wipes comprising a cassette filed with at least one wipe and provided with a seal comprising a tube of generally tapered form having a relatively wide mouth for receiving wipes and a relatively narrow orifice for dispensing them, the tube being divided circumferentially into relatively rigid axially extending zones and relatively flexible concave axially extending zones, so that when a wet wipe is dispensed the orifice is capable of expansion.

2. A container according to claim 1 in which the orifice of the seal has an elongated waisted elliptical form.

3. A container according to claim 1 in which the orifice of the seal has a three cornered form.

4. A container according to claim 1 in which the orifice of the seal has a pair-shaped form.

5. A container according to claim 1 in which a perforation pattern is formed between two successive wipes, said pattern having a perforation strength.

6. A container according to claim 5 in which the ratio between a pulling force necessary to dispense the wipes and the perforation strength of the wipes falls within the range of from 1:1 to 1:2.

* * * * *